US009151478B2

(12) United States Patent
Noonan

(10) Patent No.: US 9,151,478 B2
(45) Date of Patent: Oct. 6, 2015

(54) LANTERN STAND

(71) Applicant: John F. Noonan, Lincoln, NE (US)

(72) Inventor: John F. Noonan, Lincoln, NE (US)

( * ) Notice: Subject to any disclaimer, the term of this patent is extended or adjusted under 35 U.S.C. 154(b) by 53 days.

(21) Appl. No.: 14/177,747

(22) Filed: Feb. 11, 2014

(65) Prior Publication Data

US 2015/0226411 A1 Aug. 13, 2015

(51) Int. Cl.
*A45F 3/44* (2006.01)
*F21V 21/14* (2006.01)

(52) U.S. Cl.
CPC ..... *F21V 21/145* (2013.01)

(58) Field of Classification Search
CPC ..... A45F 3/44; F21V 21/0824; F21V 21/12; F21V 21/116; F21L 19/00; A47G 7/042; E04H 12/2215
See application file for complete search history.

(56) References Cited

U.S. PATENT DOCUMENTS

| | | | | | |
|---|---|---|---|---|---|
| 2,261,527 | A | * | 11/1941 | Shannon | 248/545 |
| 3,076,557 | A | * | 2/1963 | Husted et al. | 211/196 |
| 3,199,818 | A | | 8/1965 | Ahara | |
| 3,285,554 | A | | 11/1966 | Voelkerding | |
| 3,995,796 | A | | 12/1976 | Kline | |
| 3,998,418 | A | * | 12/1976 | Boulanger | 248/309.1 |
| 4,625,937 | A | * | 12/1986 | Haase | 248/545 |
| 4,691,851 | A | * | 9/1987 | Aaserude | 224/482 |
| D305,071 | S | * | 12/1989 | Tripp | D26/138 |
| 5,108,058 | A | * | 4/1992 | White | 248/126 |
| 5,390,884 | A | * | 2/1995 | Skoff et al. | 248/156 |
| 5,564,822 | A | | 10/1996 | Golden | |
| D445,946 | S | | 7/2001 | Kleinsasser | |
| 6,457,683 | B1 | * | 10/2002 | Armstrong, Sr. | 248/122.1 |
| 6,490,823 | B1 | | 12/2002 | Ibarra | |
| 6,736,358 | B2 | * | 5/2004 | Johnson | 248/125.3 |
| 6,793,367 | B1 | * | 9/2004 | Chan | 362/190 |
| 7,182,042 | B1 | * | 2/2007 | Anderson | 119/432 |
| 8,038,330 | B2 | * | 10/2011 | Liu | 362/413 |
| 2007/0158525 | A1 | * | 7/2007 | Anderson | 248/514 |
| 2009/0278020 | A1 | * | 11/2009 | Marcil | 248/545 |
| 2011/0239376 | A1 | * | 10/2011 | Schmidt | 7/167 |

* cited by examiner

*Primary Examiner* — Bradley Duckworth
(74) *Attorney, Agent, or Firm* — Dennis L. Thomte; Thomte Patent Law Office LLC

(57) ABSTRACT

Two embodiments of a lantern stand are described for supporting a lantern therefrom. In both embodiments, an extension tube is selectively positioned in either a stowed position or an operative position. In the first embodiment, the extension tube thereof has a spike portion extending downwardly therefrom for insertion into the ground. In the second embodiment, an auger portion extends downwardly therefrom for insertion into the ground. In the second embodiment, a pair of spaced-apart rotatable handles are provided to assist the rotational insertion of the auger portion into the ground.

5 Claims, 7 Drawing Sheets

LANTERN STAND

BACKGROUND OF THE INVENTION

1. Field of the Invention

This invention relates to a stand for supporting a lantern above the ground at a camping site, fishing site or other location wherein it is desired to illuminate the area in a convenient and safe manner. Further, this invention relates to a lantern stand which includes an extension pole or tube which may be used to elevate a lantern some distance above the ground and which provides a unique means for storing the extension pole or tube during times of storage, travel or non-use.

2. Description of the Related Art

Many types of lantern stands have been previously provided. Further, many types of lantern stands have been previously provided which include extension poles or tubes. However, to the best of Applicant's knowledge, no one has provided a convenient means for storing the extension pole or tube during times of non-use. Additionally, to the best of Applicant's knowledge, the prior art does not disclose a convenient means for driving the lower end of the lantern stand into hard ground.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

Two embodiments of the lantern stand of this invention are disclosed for supporting a lantern above the ground. In the first embodiment, the lantern stand includes an elongated, upstanding first tubular portion having upper and lower ends. The lower end of the first tubular portion has an elongated connector rod extending downwardly from the first tubular portion. The lantern stand also includes a second tubular portion having upper and lower ends. The lower end of the second tubular portion is secured to the upper end of the first tubular portion. The second tubular portion extends upwardly and outwardly from the upper end of the first tubular portion. A third elongated and upstanding tubular portion, having upper and lower ends, has its lower end secured to the upper end of the second tubular portion. A fourth tubular portion, having upper and lower ends, has its lower end secured to the upper end of the third tubular portion. The fourth tubular portion extends upwardly and inwardly from the upper end of the third tubular portion. A vertically disposed cylindrical shaft, having upper and lower ends, has its upper end secured to the upper end of the fourth tubular portion. The cylindrical shaft has a vertically disposed and recessed flat surface, having upper and lower ends, formed therein. The cylindrical shaft has an upwardly presented lantern support slot formed therein at the lower end thereof. A first collar, having upper and lower ends, is vertically movably mounted on the cylindrical shaft. The first collar is movable between upper and lower positions with respect to the cylindrical shaft. A horizontally disposed pin extends through the first collar so as to be positioned adjacent the flat surface. The pin is received in the slot when the first collar is in the lower position. An elongated coil spring, having upper and lower ends, embraces the cylindrical shaft above the first collar which yieldably urges the first collar to its lower position. The slot is exposed when the first collar is in the upper position. An upwardly presented socket is secured to the first tubular portion above the connector rod.

The lantern stand also includes an elongated extension tube having upper and lower ends. A second collar, having upper and lower ends, is secured to the upper end of the extension tube so as to embrace the upper end of the extension tube. The lower end of the extension tube has a spike portion extending downwardly therefrom. The extension tube is selectively positioned in a stowed position and an operative position. The extension tube, when positioned in the operative position, has its upper end embracing the connector rod at the lower end of the first tubular portion. The extension tube, when positioned in the stowed position, has the spike portion thereof selectively received by the socket and has its upper end received by the lower end of the cylindrical shaft. The extension tube, when positioned in the stowed position, is yieldably urged downwardly by the coil spring due to the engagement of the first collar and the second collar so that the spike portion is yieldably held in the socket.

The second embodiment of the lantern stand of this invention is essentially identical to the first embodiment except that an auger portion extends downwardly from the lower end of the extension tube. An upper handle is rotatably mounted on the third tubular portion and a rotatable handle is rotatably mounted on the first tubular portion. The rotatable handles assist in auguring the auger portion of the extension tube into the ground.

It is therefore a principal object of the invention to provide an improved lantern stand.

A further object of the invention is to provide a lantern stand which includes an extension tube which is selectively positioned between an operative position and a stowed position.

A further object of the invention is to provide a lantern stand which is adapted to securely maintain a lantern thereon.

Yet another object of the invention is to provide a lantern stand which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
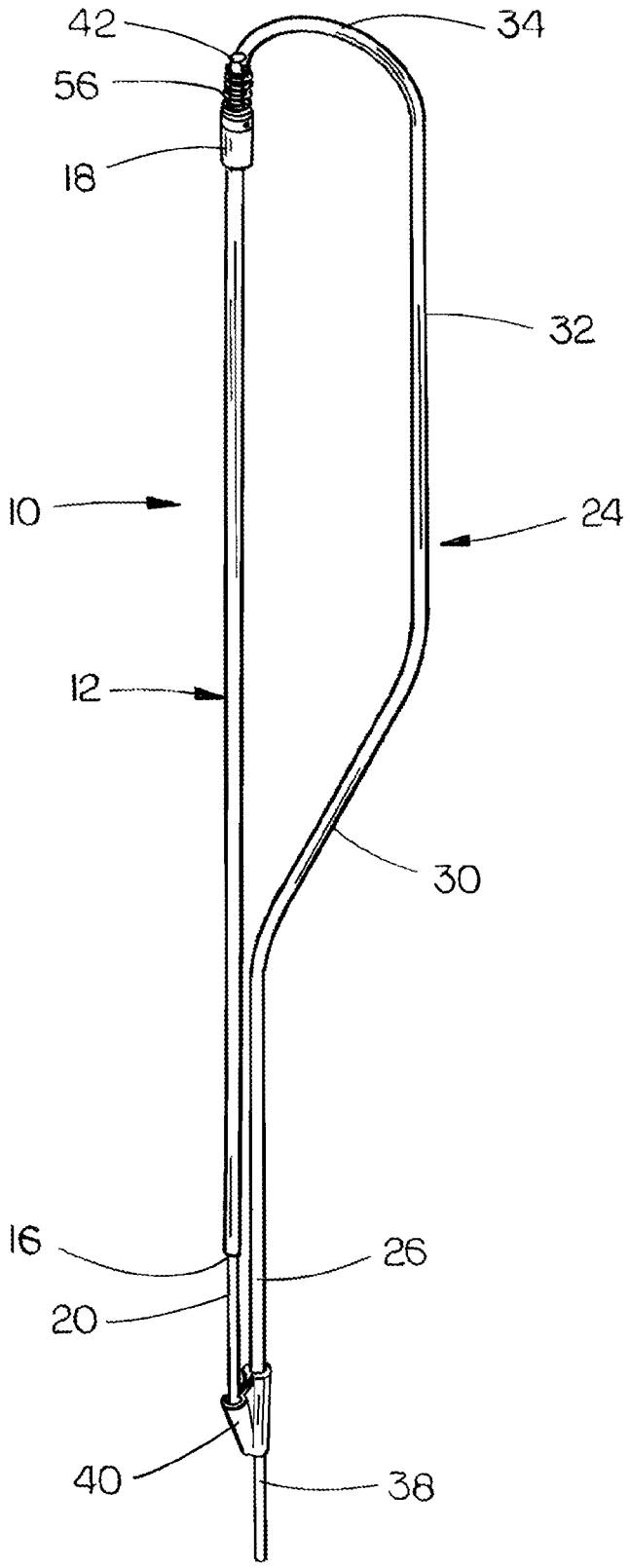
FIG. 1 is a perspective view of the first embodiment of this invention with the extension pole in a stowed position.
Figure 2:
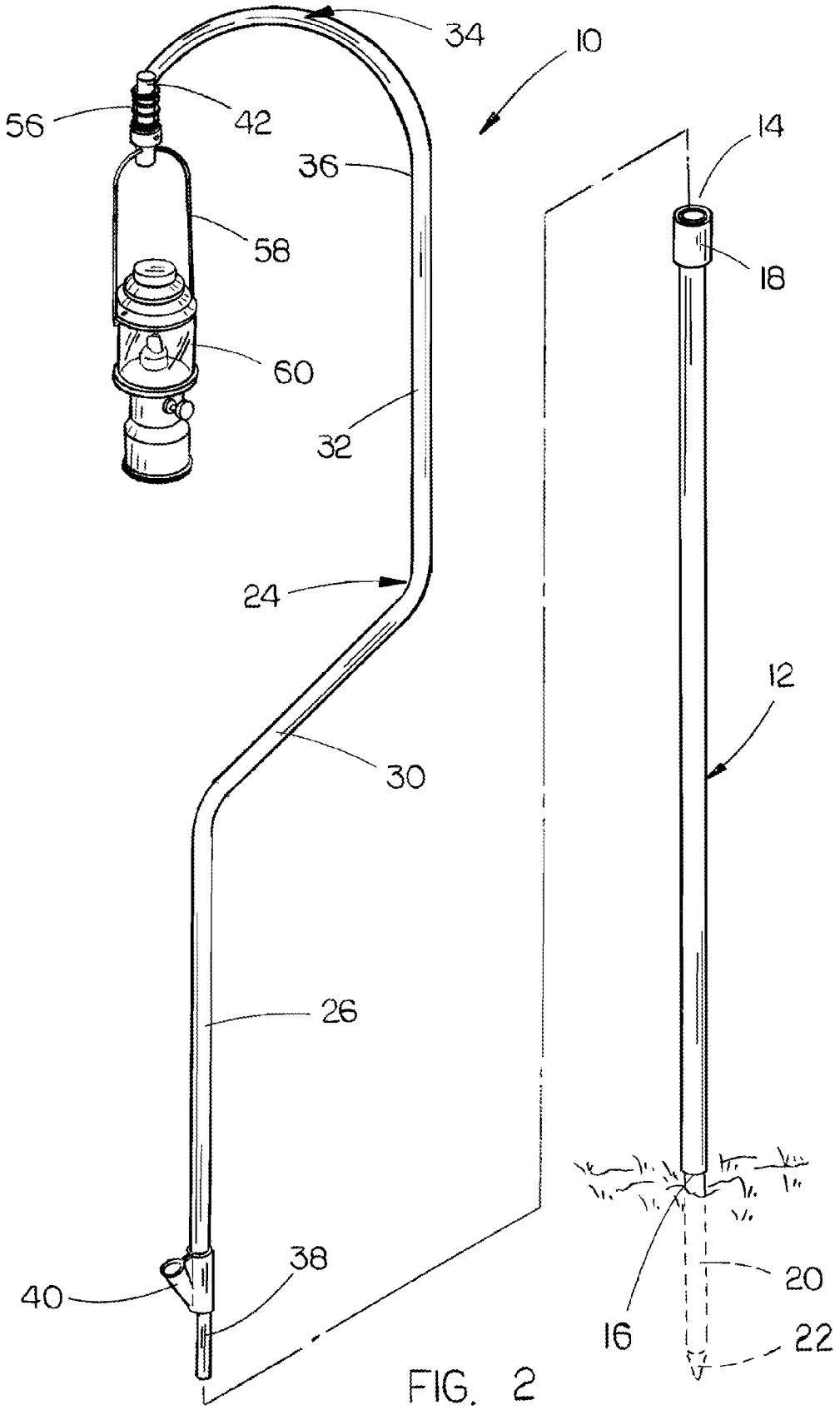
FIG. 2 is an exploded perspective view of the first embodiment supporting a lantern.
Figure 4:
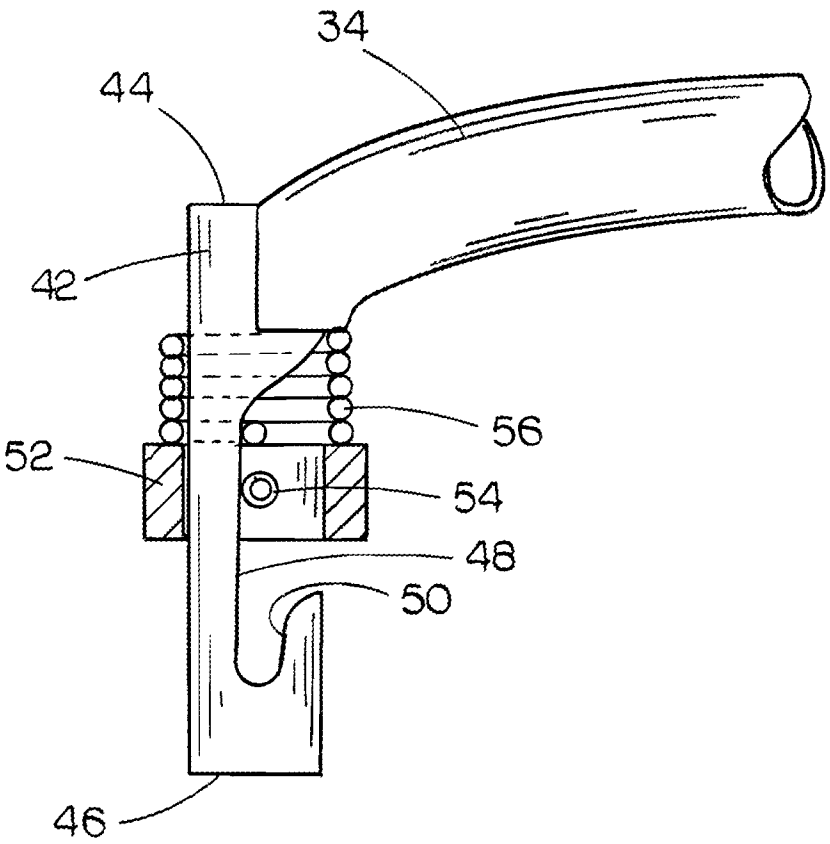
FIG. 4 is a view similar to FIG. 3 except that the lantern supporting structure is in the lantern receiving position.
Figure 3:
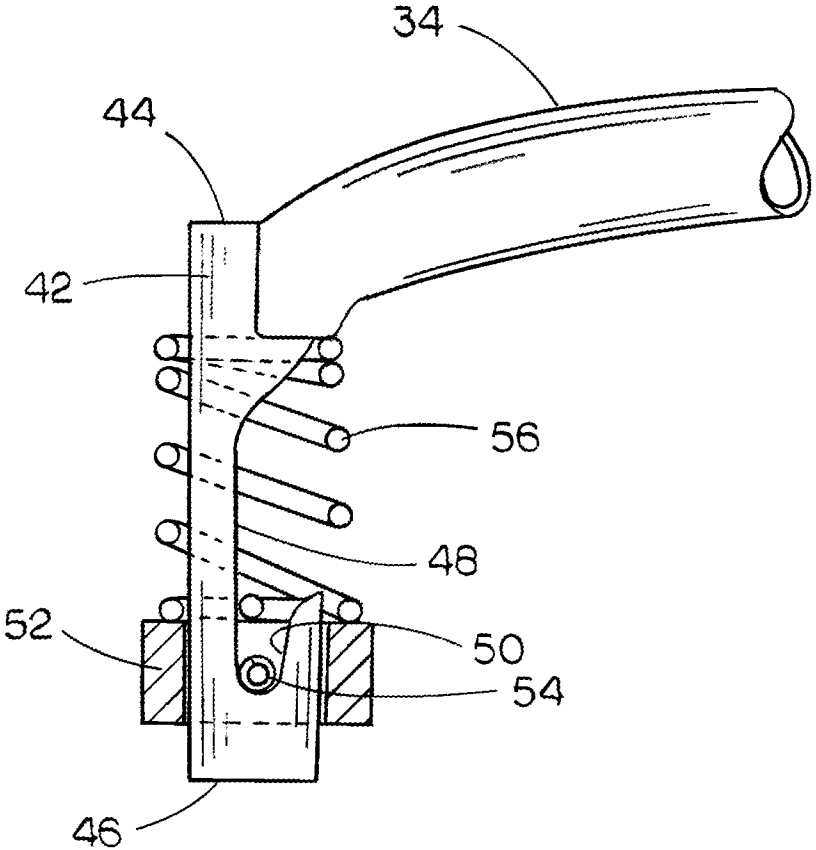
FIG. 3 is a partial sectional view of the lantern supporting structure in its lower lantern supporting position.
Figure 5:
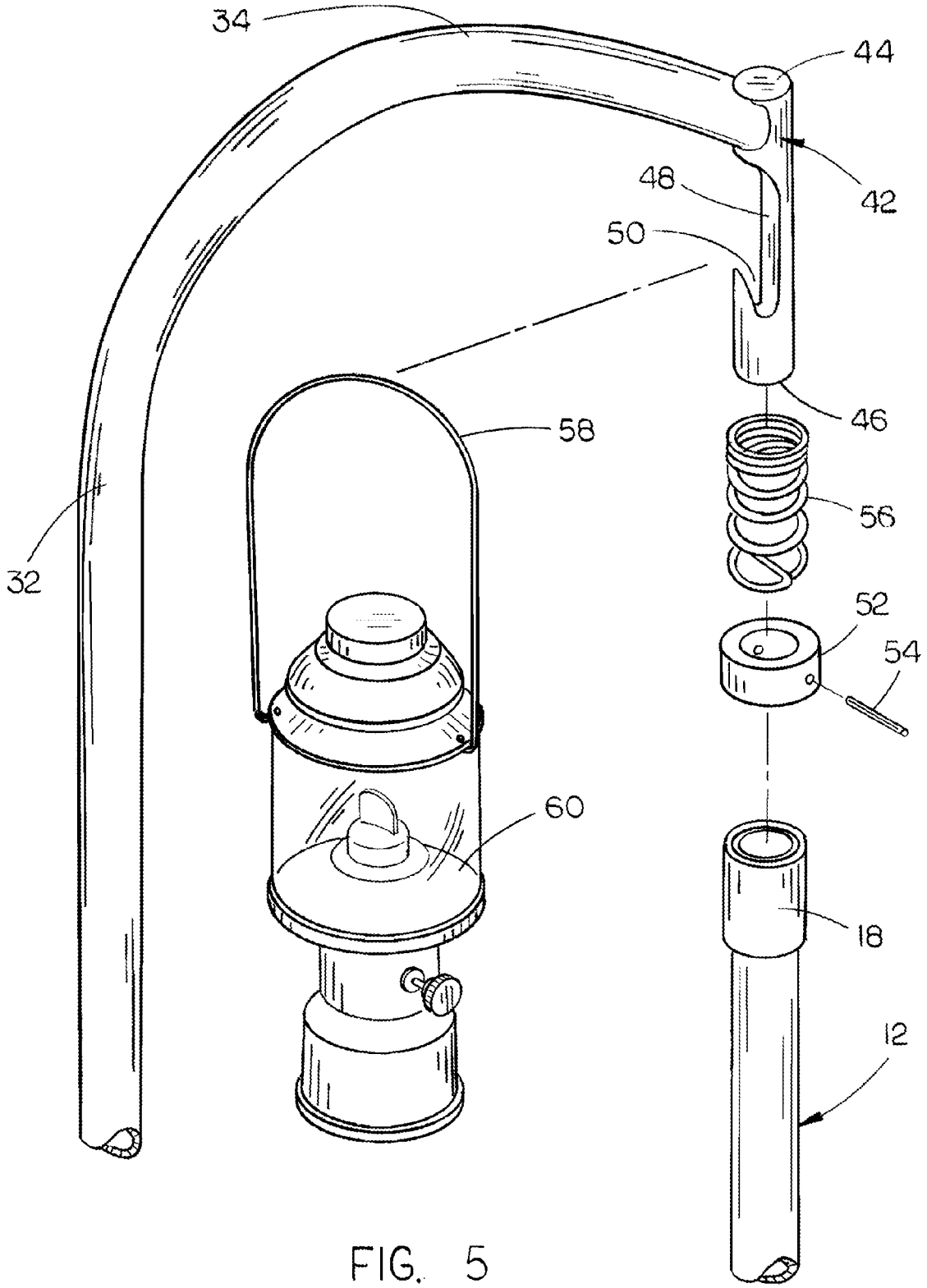
FIG. 5 is a partial exploded perspective view of the first embodiment of this invention.
Figure 6:
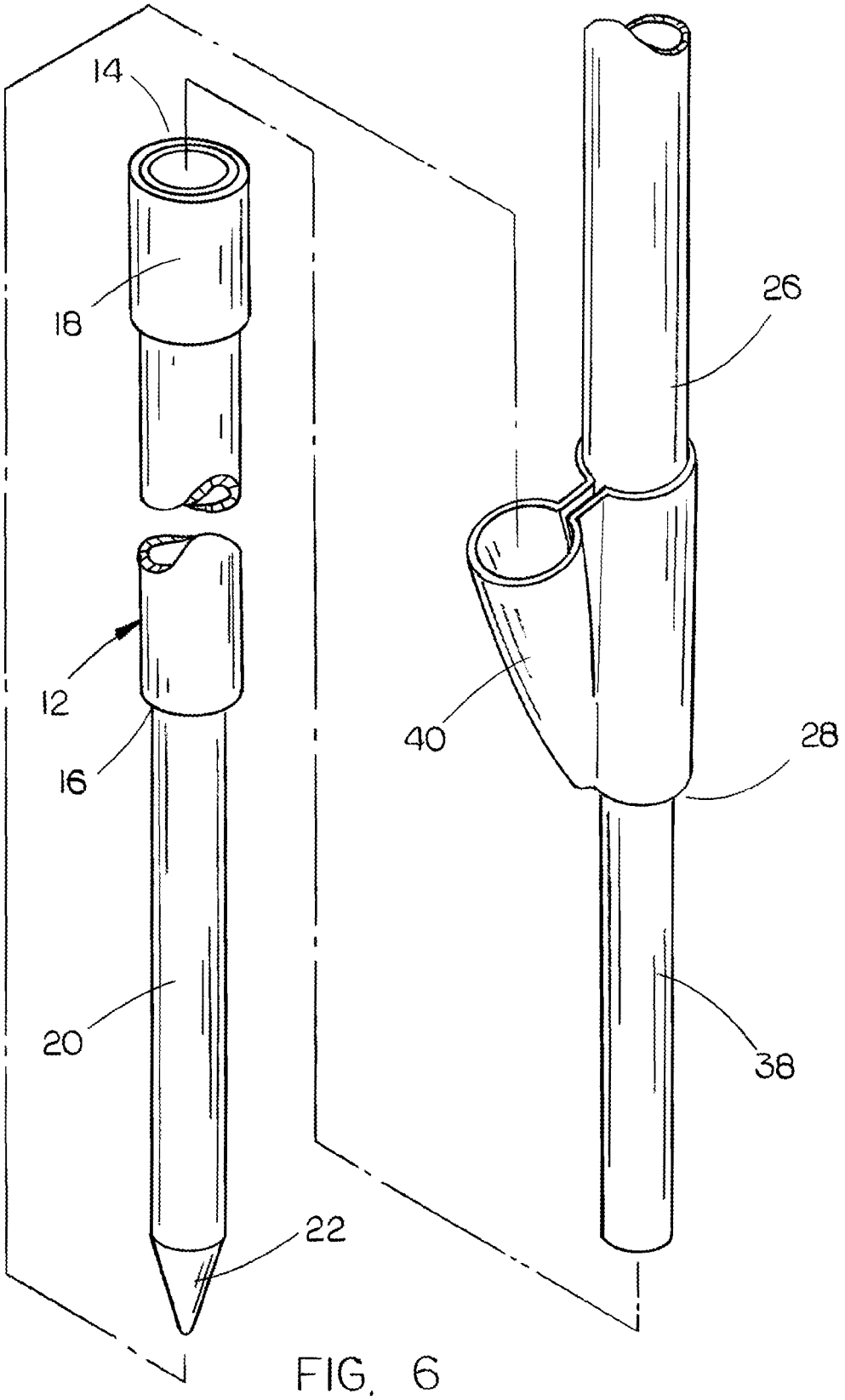
FIG. 6 is a partial exploded perspective view.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The lantern stand of this invention is referred to generally by the reference numeral 10. Stand 10 includes a hollow extension tube 12 having an upper end 14 and a lower end 16. A hollow collar 18 is secured to the upper end 14 of tube 12 so as to embrace the same. A spike 20 is secured to the lower end 16 of tube 12 and extends downwardly therefrom. Spike 20 has a pointed portion 22 at its lower end.

The numeral 24 refers to a lantern support member which includes a first vertically disposed hollow tubular portion 26, having a lower end 28, a second tubular portion 30 which extends upwardly and outwardly from the upper end of tubular portion 26, a tubular portion 32 which extends upwardly from the upper end of tube portion 30, and a fourth tubular portion 34, having a lower end 36, which extends upwardly and inwardly from the upper end of third tubular portion 32. A connector rod 38 is secured to the lower end of first tubular portion 26 and extends downwardly therefrom. Connector rod 38 has a smaller outer diameter than first tubular portion 26 and has all outer diameter less than the inside diameter of the upper end 14 of extension tube 12 so that the lower end of connector rod 38 may be inserted into the upper end 14 of extension tube 12 as will be described in greater detail hereinafter. A hollow socket 40 is secured to the lower end of tubular portion 26 and extends upwardly and slightly outwardly from tubular portion 26.

A vertically disposed shaft or rod 42, having an upper end 44 and a lower end 46, is secured to the outer end of tubular portion 34 and extends downwardly therefrom. Shaft 42 has a flat surface 48 milled therein at the inner side of shaft 42 which extends partially along the upper length thereof. An upwardly presented slot 50 is formed in shaft 42 at the lower end of flat surface 48. A collar 52 vertically slidably embraces shaft 42 and has a pin 54 extending between the sides thereof. Pin 54 is movably positioned adjacent flat surface 48 and may be received in slot 50 as will be described hereinafter. A coil spring 56 embraces shaft 42 between the upper end thereof and the upper end of the collar 52 which yieldably urges collar 52 downwardly with respect to shaft 42. The downward movement of collar 52 on shaft 42 is limited by the engagement of the pin 54 with the lower end of the slot 50.

In the uppermost position of collar 52 on shaft 42, the upper end of slot 50 is exposed. In the lower most position of collar 52, on shaft 42, the lower end 46 of shaft 42 is exposed.

When it is desired to erect lantern stand 10, the connector rod 38 is inserted into the upper end 14 of extension tube 12. The spike 20 is then pushed into the ground so that the stand 10 is vertically disposed. The collar 52 is then moved upwardly on shaft 42 to expose slot 50. The handle 58 of a lantern 60 is then inserted into the slot 50. The collar 52 is then released so that the spring 56 moves collar 52 downwardly on shaft 42 to yieldably maintain the handle 58 of the lantern 60 in the slot 50.

When it is desired to transport the stand 10 or store the stand 10, the lantern 60 is removed from the stand 10 by moving collar 52 upwardly on shaft 42 until the upper end of the slot 50 is exposed. The handle 58 of the lantern 60 is then removed from the slot 50 and the collar 52 is released so that the collar 52 moves to its lowermost position on shaft 42.

Tubular portion 26 is then disconnected from extension tube 12. Extension tube 12 is then pulled upwardly from ground engagement. The upper end 14 of extension tube 12 is then positioned on the exposed lower end 46 of shaft 42. The extension tube 12 is then moved upwardly with respect to shaft 42 which causes collar 52 to move upwardly on shaft 42. The upward movement of extension tube 12 on shaft 42 is continued until the lower pointed end 22 of spike 20 is positioned above the open upper end of socket 40. When the pointed portion 22 of spike 20 is positioned above socket 40, the upward pressure on extension tube 12 is relaxed so that spring 56 causes extension tube 12 to move downwardly so that the pointed portion 22 of spike 20 is received in the socket 40. The extension tube 12 will remain in the socket 40 and the upper end of the extension tube 12 will remain on the lower end of the shaft 42 due to the force of the spring 56. The connection of the upper end of extension tube 12 with the lower end of the shaft 42 together with the insertion of the pointed portion 22 of spike 20 provides a convenient means for positioning the extension tube 12 for storage or transport.

When it is desired to again use the stand 10, upward force is applied to extension tube 12, which causes the upper end of extension tube 12 to move upwardly on shaft 42 against the resistance of the spring 56, until the lower end of the pointed portion 22 of spike 20 has cleared the socket 40. The lower end of the extension tube 12 is then moved laterally with respect to socket 40 and the upward pressure on extension tube is released so that the upper end of extension tube 12 is disengaged from shaft 42. The extension tube 12 may then be attached to the lower end of tube portion 26 as previously described. Thus, the lantern stand of this invention enables the convenient storage of an extension tube 12 when the extension tube 12 is not being used.

Figure 7:
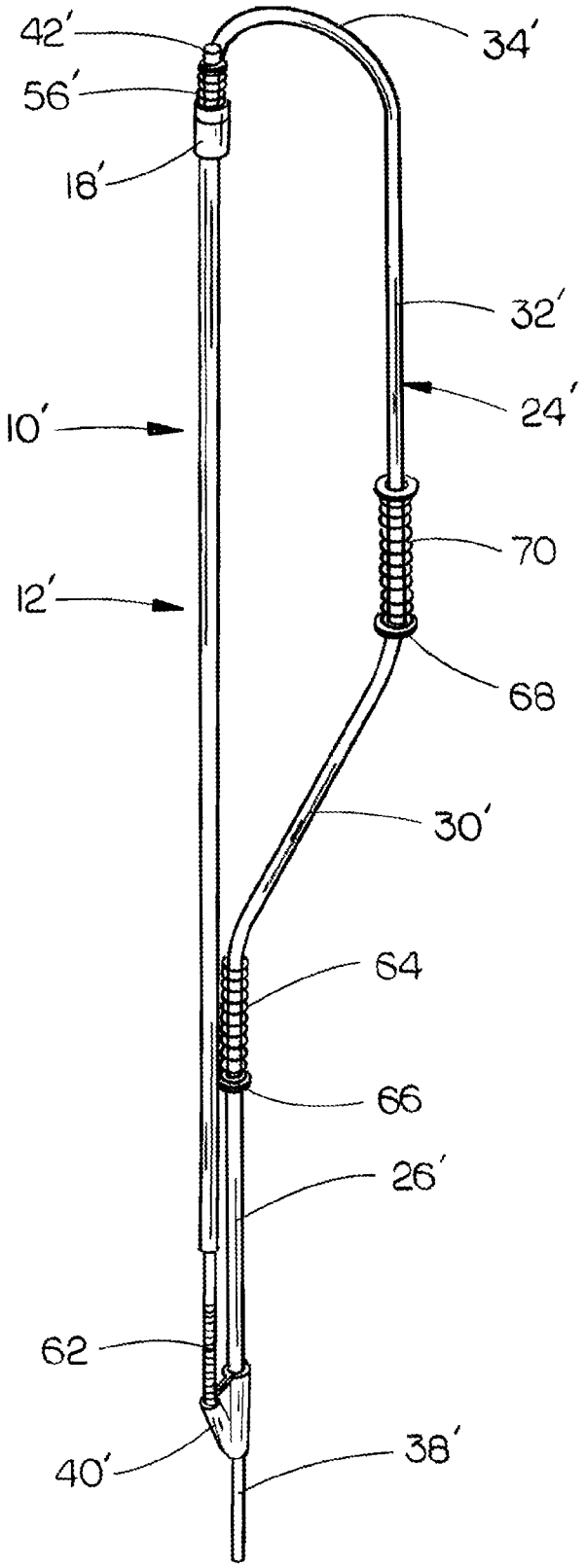
FIG. 7 is a perspective view of the second embodiment of this invention.
Figure 8:
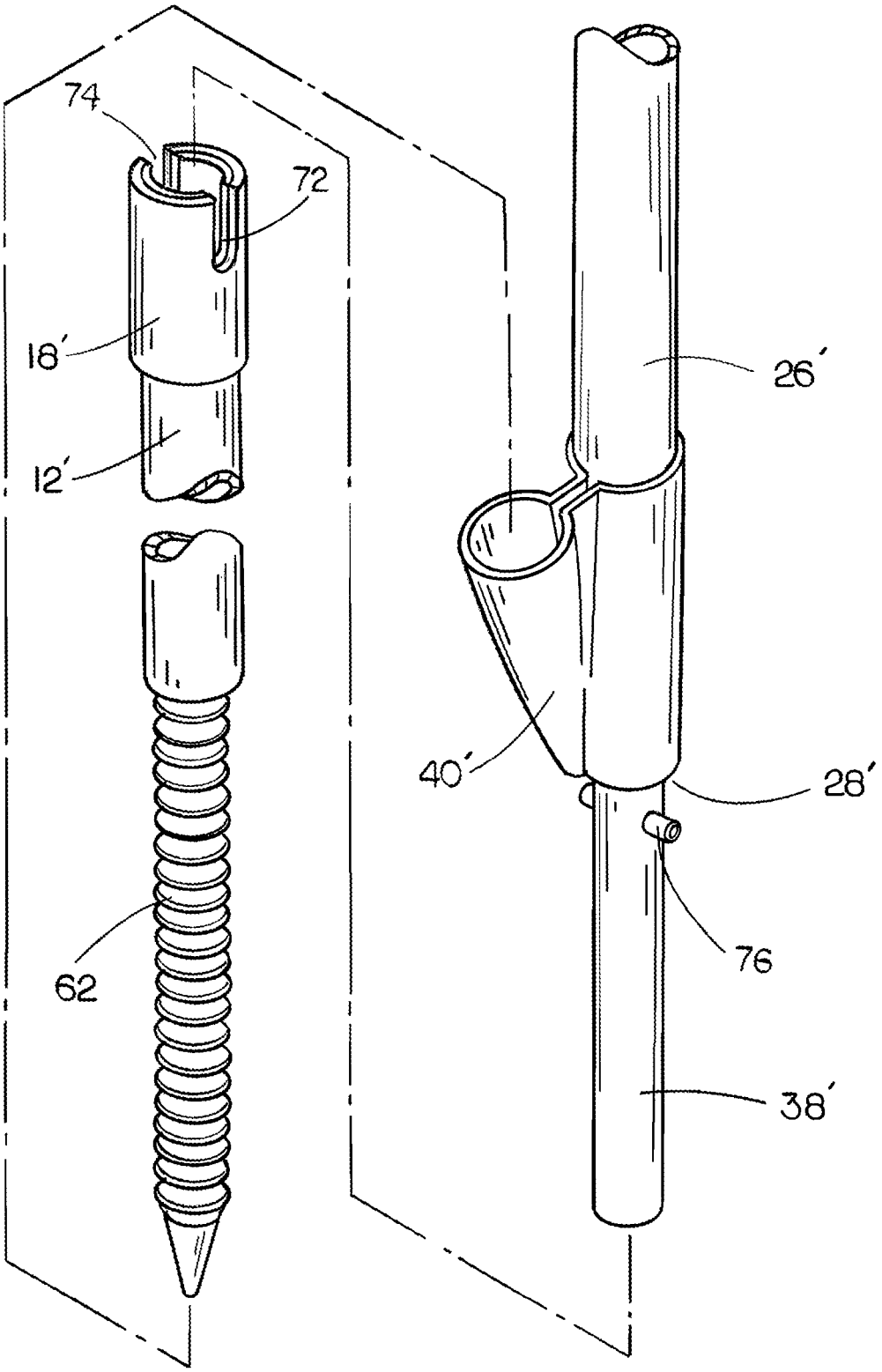
FIG. 8 is a partial exploded perspective view of the second embodiment of this invention.

The second embodiment of the lantern stand of this invention is shown in FIGS. 7 and 8 and is designated by the reference numeral 10'. Inasmuch as almost all of the components of the lantern stand 10' are identical to the components of the lantern stand 10, those components of lantern stand 10' which are identical to the components of lantern stand 10, will be designated by "'". There are four primary differences between lantern stand 10 and lantern stand 10' which will now be described. In lantern stand 10 the spike 20 of lantern stand 10 is replaced with a screw-like auger member 62 which is secured to the lower end of the extension tube 12'. In lantern stand 10' a ring-shaped retainer 66 is secured to tube portion 26' below the upper end thereof. A handle or spring 64 rotatably embraces the upper end of tube portion 26' above retainer 66. In lantern 10' a ring-shaped retainer 68 is secured to tubular portion 32' adjacent the lower end thereof. A handle or spring 70 rotatably embraces tubular portion 32 above retainer 68. Another difference between lantern stand 10 and lantern stand 10' is that lantern stand 10' includes means to ensure that auger member 62 will be rotated upon the rotation and support member 24'. The upper ends of collar 18' and extension tube 12' have opposing U-shaped slots 72 and 74 formed therein which are adapted to receive the opposite ends of a pin 76 which extends through connector rod 38' near the upper end thereof.

When collar 18' is slipped onto the connector rod 38, the opposite ends of pin 76 are received in slots 72 and 74 to ensure that extension rod 12' and auger member 62 will be rotated when support member 24' is rotated.

In use, after the extension tube 12' has been secured to the lower end of tubular portion 26' the auger member 62 is rotatably driven into the ground by the user grasping the rotatable handles 64 and 70 and rotating the lantern stand 10'. The extension tube 12' is stowed in the same manner as extension tube 12 is stowed with the lower end of auger member 62 being received by the socket 40'.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A lantern stand, comprising:

an elongated, upstanding first tubular portion having upper and lower ends;

said lower end of said first tubular portion having an elongated connector rod extending downwardly from said first tubular portion;

a second tubular portion having upper and lower ends;

said lower end of said second tubular portion being secured to said upper end of said first tubular portion;

said second tubular portion extending upwardly and outwardly from said upper end of said first tubular portion;

a third elongated upstanding tubular portion having upper and lower ends;

said lower end of said third tubular portion being secured to said upper end of said second tubular portion;

a fourth tubular portion having upper and lower ends;

said lower end of said fourth tubular portion being secured to said upper end of said third tubular portion;

said fourth tubular portion extending upwardly and inwardly from said upper end of said third tubular portion;

a vertically disposed cylindrical shaft having upper and lower ends;

said upper end of said cylindrical shaft being secured to the upper end of said fourth tubular portion;

said cylindrical shaft having a vertically disposed and recessed flat surface, having upper and lower ends, formed therein;

said cylindrical shaft having an upwardly presented lantern support slot formed therein at said lower end of said flat surface;

a first collar, having upper and lower ends, vertically movably mounted on said cylindrical shaft;

said first collar being movable between upper and lower positions with respect to said cylindrical shaft;

a horizontally disposed pin extending through said first collar;

said pin being positioned adjacent said flat surface;

said pin being received in said slot when said first collar is in said lower position;

an elongated coil spring, having upper and lower ends, embracing said cylindrical shaft above said first collar which yieldably urges said first collar to said lower position;

said slot being exposed when said first collar is in said upper position;

an upwardly presented socket secured to said first tubular portion above said connector rod;

an elongated extension tube having upper and lower ends;

a second collar, having upper and lower ends, secured to said upper end of said extension tube so as to embrace said upper end of said extension tube;

said lower end of said extension tube having a spike portion extending downwardly therefrom;

said extension tube being selectively positioned in a stowed position and an operative position;

said extension tube, when positioned in said operative position, having said upper end thereof embracing said connector rod at said lower end of said first tubular portion;

said extension tube, when positioned in said stowed position, having said spike portion selectively received by said socket and having said upper end thereof receiving said lower end of said cylindrical shaft;

said extension tube, when positioned in said stowed position, being yieldably urged downwardly by said coil spring due to the engagement of said first collar and said second collar so that said spike portion is yieldably held in said socket.

2. A lantern stand, comprising:

an elongated, upstanding first tubular portion having upper and lower ends;

said lower end of said first tubular portion having an elongated connector rod extending downwardly from said first tubular portion;

a second tubular portion having upper and lower ends;

said lower end of said second tubular portion being secured to said upper end of said first tubular portion;

said second tubular portion extending upwardly and outwardly from said upper end of said first tubular portion;

a third elongated upstanding tubular portion having upper and lower ends;

said lower end of said third tubular portion being secured to said upper end of said second tubular portion;

a fourth tubular portion having upper and lower ends;

said lower end of said fourth tubular portion being secured to said upper end of said third tubular portion;

said fourth tubular portion extending upwardly and inwardly from said upper end of said third tubular portion;

a vertically disposed cylindrical shaft having upper and lower ends;

said upper end of said cylindrical shaft being secured to the upper end of said fourth tubular portion;

said cylindrical shaft having a vertically disposed and recessed flat surface, having upper and lower ends, formed therein;

said cylindrical shaft having an upwardly presented lantern support slot formed therein at said lower end of said flat surface;

a first collar, having upper and lower ends, vertically movably mounted on said cylindrical shaft;

said first collar being movable between upper and lower positions with respect to said cylindrical shaft;

a horizontally disposed pin extending through said first collar;

said pin being positioned adjacent said flat surface;

said pin being received in said slot when said first collar is in said lower position;

an elongated coil spring, having upper and lower ends, embracing said cylindrical shaft above said first collar which yieldably urges said first collar to said lower position;

said slot being exposed when said first collar is in said upper position;

an upwardly presented socket secured to said first tubular portion above said connector rod;

an elongated extension tube having upper and lower ends;

a second collar, having upper and lower ends, secured to said upper end of said extension tube so as to embrace said upper end of said extension tube;

said lower end of said extension tube having an auger portion extending downwardly therefrom;

said extension tube being selectively positioned in a stowed position and an operative position;

said extension tube, when positioned in said operative position, having said upper end thereof embracing said connector rod at said lower end of said first tubular portion;

said extension tube, when positioned in said stowed position, having said auger portion selectively received by said socket and having said upper end thereof receiving said lower end of said cylindrical shaft;

said extension tube, when positioned in said stowed position, being yieldably urged downwardly by said coil spring due to the engagement of said first collar and said second collar so that said auger portion is yieldably held in said socket;

an elongated and vertically disposed upper handle rotatably mounted, about a vertical axis, on said third tubular portion at said lower end of said third tubular portion; and an elongated and vertically disposed lower handle rotatably mounted, about a vertical axis, on said first tubular portion at said upper end of said first tubular portion.

3. The lantern stand of claim 2 wherein said upper and lower handles are metal coil springs.

4. A lantern stand, comprising:

an elongated, upstanding first tubular portion having upper and lower ends;

said lower end of said first tubular portion having an elongated connector rod extending downwardly from said first tubular portion;

a second tubular portion having upper and lower ends;

said lower end of said second tubular portion being secured to said upper end of said first tubular portion;

said second tubular portion extending upwardly and outwardly from said upper end of said first tubular portion;

a third elongated upstanding tubular portion having upper and lower ends;

said lower end of said third tubular portion being secured to said upper end of said second tubular portion;

a fourth tubular portion having upper and lower ends;

said lower end of said fourth tubular portion being secured to said upper end of said third tubular portion;

said fourth tubular portion extending upwardly and inwardly from said upper end of said third tubular portion;

a vertically disposed cylindrical shaft having upper and lower ends;

said upper end of said cylindrical shaft being secured to the upper end of said fourth tubular portion;

said cylindrical shaft having an upwardly presented lantern slot formed therein at said lower end thereof;

a first collar, having upper and lower ends, vertically movably mounted on said cylindrical shaft;

said first collar being movable between upper and lower positions with respect to said cylindrical shaft;

said lower end of said cylindrical shaft being exposed when said first collar is in said lower position;

an elongated coil spring, having upper and lower ends, embracing said cylindrical shaft above said first collar which yieldably urges said first collar to said lower position;

said slot being exposed when said first collar is in said upper position;

an upwardly presented socket secured to said first tubular portion above said connector rod;

an elongated extension tube having upper and lower ends;

a second collar, having upper and lower ends, secured to said upper end of said extension tube so as to embrace said upper end of said extension tube;

said lower end of said extension tube having a spike portion extending downwardly therefrom;

said extension tube being selectively positioned in a stowed position and an operative position;

said extension tube, when positioned in said operative position, having said upper end thereof embracing said connector rod at said lower end of said first tubular portion;

said extension tube, when positioned in said stowed position, having said spike portion selectively received by said socket and having said upper end thereof receiving said lower end of said cylindrical shaft;

said extension tube, when positioned in said stowed position, being yieldably urged downwardly by said coil spring due to the engagement of said first collar and said second collar so that said spike portion is yieldably held in said socket.

5. A lantern stand, comprising:

an elongated, upstanding first tubular portion having upper and lower ends;

said lower end of said first tubular portion having an elongated connector rod extending downwardly from said first tubular portion;

a second tubular portion having upper and lower ends;

said lower end of said second tubular portion being secured to said upper end of said first tubular portion;

said second tubular portion extending upwardly and outwardly from said upper end of said first tubular portion;

a third elongated upstanding tubular portion having upper and lower ends;

said lower end of said third tubular portion being secured to said upper end of said second tubular portion;

a fourth tubular portion having upper and lower ends;

said lower end of said fourth tubular portion being secured to said upper end of said third tubular portion;

said fourth tubular portion extending upwardly and inwardly from said upper end of said third tubular portion;

a vertically disposed cylindrical shaft having upper and lower ends;

said upper end of said cylindrical shaft being secured to the upper end of said fourth tubular portion;

said cylindrical shaft having an upwardly presented lantern slot formed therein at said lower end thereof;

a first collar, having upper and lower ends, vertically movably mounted on said cylindrical shaft;

said first collar being movable between upper and lower positions with respect to said cylindrical shaft;

said lower end of said cylindrical shaft being exposed when said first collar is in said lower position;

an elongated coil spring, having upper and lower ends, embracing said cylindrical shaft above said first collar which yieldably urges said first collar to said lower position;

said slot being exposed when said first collar is in said upper position;

an upwardly presented socket secured to said first tubular portion above said connector rod;

an elongated extension tube having upper and lower ends;

a second collar, having upper and lower ends, secured to said upper end of said extension tube so as to embrace said upper end of said extension tube;

said lower end of said extension tube having an auger portion extending downwardly therefrom;

said extension tube being selectively positioned in a stowed position and an operative position;

said extension tube, when positioned in said operative position, having said upper end thereof embracing said connector rod at said lower end of said first tubular portion;

said extension tube, when positioned in said stowed position, having said auger portion selectively received by said socket and having said upper end thereof receiving said lower end of said cylindrical shaft;

said extension tube, when positioned in said stowed position, being yieldably urged downwardly by said coil spring due to the engagement of said first collar and said second collar so that said auger portion is yieldably held in said socket.

* * * * *